US008169453B2

(12) United States Patent
Mindler et al.

(10) Patent No.: US 8,169,453 B2
(45) Date of Patent: May 1, 2012

(54) THERMALLY CONDUCTIVE, ELECTRICALLY ISOLATED PEEL MEMBER ASSEMBLY

(75) Inventors: Robert F. Mindler, Churchville, NY (US); Richard Harold Ellis, Rochester, NY (US); David B. Hilton, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 798 days.

(21) Appl. No.: 12/183,529

(22) Filed: Jul. 31, 2008

(65) Prior Publication Data

US 2010/0026776 A1 Feb. 4, 2010

(51) Int. Cl.
*B41J 2/325* (2006.01)

(52) U.S. Cl. ..... 347/216

(58) Field of Classification Search ..... 347/216
See application file for complete search history.

(56) References Cited

U.S. PATENT DOCUMENTS

| | | | | |
|---|---|---|---|---|
| 4,666,319 | A * | 5/1987 | Hirosaki et al. | 156/384 |
| 4,860,159 | A * | 8/1989 | Rodrigo | 361/212 |
| 5,342,131 | A * | 8/1994 | Nakajima et al. | 400/120.01 |
| 5,440,328 | A | 8/1995 | Nardone et al. | |
| 5,709,488 | A * | 1/1998 | Imai et al. | 400/234 |
| 5,936,653 | A * | 8/1999 | Yamaguchi et al. | 347/216 |
| 6,999,108 | B2 | 2/2006 | Goff et al. | |
| 7,330,201 | B2 | 2/2008 | Mindler et al. | |

FOREIGN PATENT DOCUMENTS

| | | | |
|---|---|---|---|
| JP | 63 047168 | A | 2/1988 |
| JP | 2007 001121 | A | 1/2007 |
| JP | 2007 118498 | A | 5/2007 |

* cited by examiner

*Primary Examiner* — Huan Tran
(74) *Attorney, Agent, or Firm* — Eugene I. Shkurko

(57) ABSTRACT

A thermal printer having reduced electrical charge built at point of separation of a donor web and a receiver web, includes at least one thermal printhead and at least one platen roller with a nip is formed between the at least one thermal printhead and the at least one platen roller through which the donor web and the receiver web are drawn. A heat sink is attached to the at least one thermal printhead and a peel member is located downstream of the nip. The peel member is substantially electrically isolated from ground.

18 Claims, 11 Drawing Sheets

THERMALLY CONDUCTIVE, ELECTRICALLY ISOLATED PEEL MEMBER ASSEMBLY

FIELD OF THE INVENTION

The present invention relates to thermal printers of type that apply material from a donor web to a receiver web in order to form images on the receiver web.

BACKGROUND OF THE INVENTION

In thermal printing, it is generally well known to render images by heating and pressing one or more donor materials such as a dye, colorant or other coating against a receiver web. The donor materials are provided in sized donor patches on a movable web known as a donor ribbon. The donor patches are organized on the ribbon into donor sets; each set containing all of the donor patches that are to be used to record an image on the receiver web. For full color images, multiple color dye patches can be used, such as yellow, magenta, and cyan donor dye patches. Arrangements of other color patches can be used in like fashion within a donor set. Additionally, each donor set can include an overcoat or sealant layer.

Thermal printers offer a wide range of advantages in photographic printing including the provision of truly continuous tone scale variation and the ability to deposit, as a part of the printing process a protective overcoat layer to protect the images formed thereby from mechanical and environmental damage. Accordingly, the most popular photographic kiosks and home photo printers currently use thermal printing technology.

Electrostatic charge can be generated in thermal printers by peeling donor media from receiver media. Electrostatic charge is a significant concern and problem for makers of thermal printers, because excess static charge leads to jamming and buckling of print media as the print media traverses through the thermal printer. Conventional approaches to addressing static charge focus on the media itself in that, ionic or nonionic anti-stats are added to the media; for example, the receiver media. This anti-static material is adjusted positionally to reduce static charge. In other words, the anti-static material may be placed in multiple locations with varying effectiveness. The anti-stats may be placed in various layers of the receiver and donor media.

Limitations of anti-stats include, for ionic anti-stats, their ineffectiveness in high humidity. Both ionic and non-ionic anti-stats are subject to great expense, and imprecise usage that is dependent upon the receiver media impacted with reduction of static charge. Another disadvantage associated with non-ionic anti-stats is an addition of unwanted color in white areas of a print.

SUMMARY OF THE INVENTION

A thermal printer having reduced electrical charge built at point of separation of a donor web and a receiver web, includes at least one thermal printhead and at least one platen roller with a nip formed between the at least one thermal printhead and the at least one platen roller through which the donor web and the receiver web are drawn. A heat sink is attached to the at least one thermal printhead and a peel member is located downstream of the nip. The peel member is electrically isolated from ground.

Another aspect of the invention provides a method for eliminating built-up electrical static charge in a thermally conductive peel member assembly that includes electrically isolating the thermal conductive peel member from ground, while maintaining the thermal conductive peel member's physical proximate contact with a heat sink assembly of a thermal printhead.

DETAILED DESCRIPTION OF THE INVENTION

Figure 1:
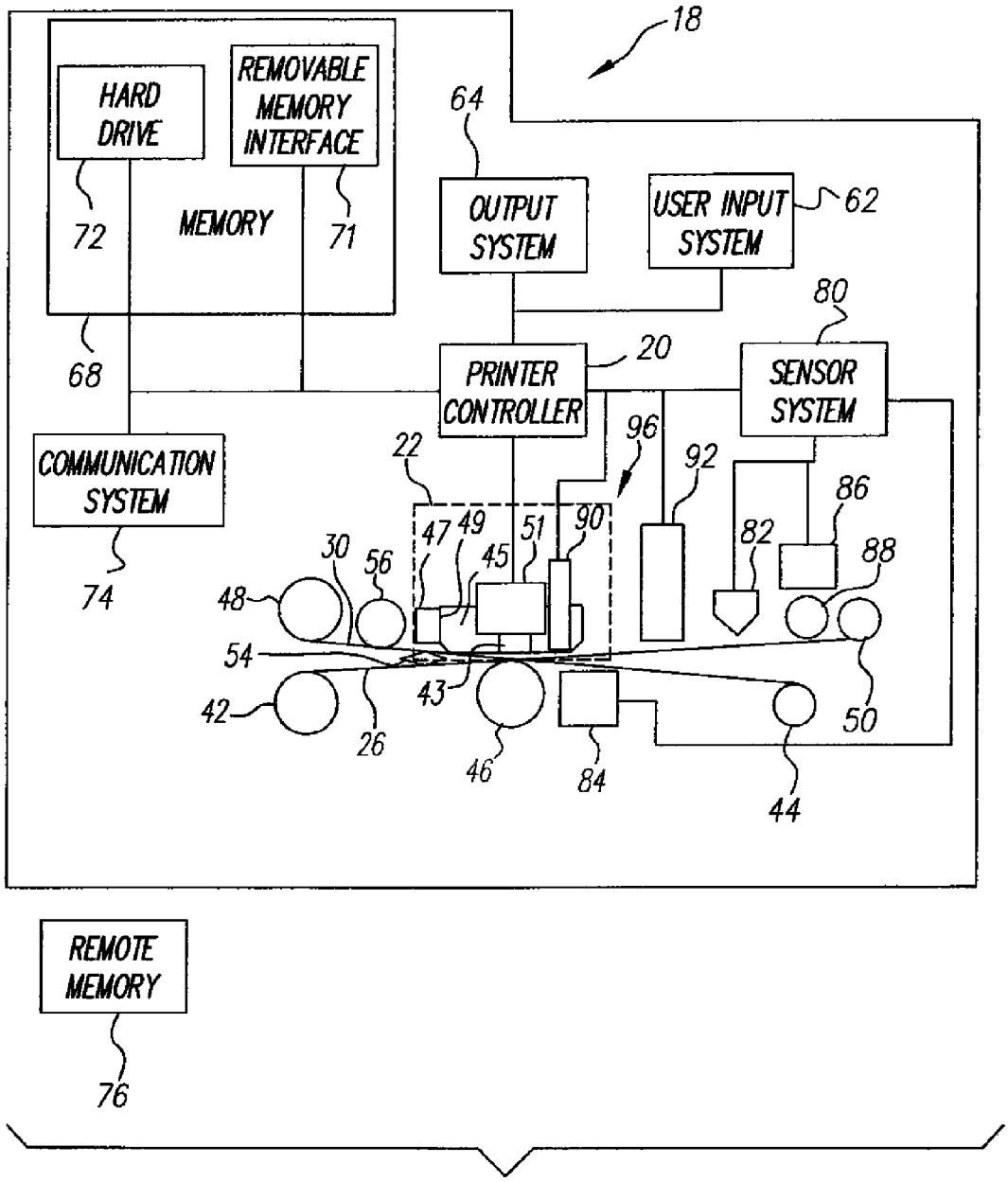
FIG. 1 shows a printer having one embodiment of the control system of the invention.

FIG. 1 shows one exemplary embodiment a printer 18 of the invention. As shown in FIG. 1, printer 18 has a controller 20 that causes thermal printhead 22 to record images on a receiver web 26 by applying heat and pressure to transfer material from a donor web 30 to receiver web 26. Controller 20 can include, but is not limited to: a programmable digital computer, a programmable microprocessor, a programmable logic controller, a series of electronic circuits, a series of electronic circuits reduced to the form of an integrated circuit, or a series of discrete components. In the embodiment of FIG. 1, controller 20 also controls a receiver web take-up roller 42, a receiver web supply roller 44, a donor web take-up roller 48, and a donor web supply roller 50; which are each motorized for rotation on command of the controller 20 to effect movement of receiver web 26 and donor web 30.

Figure 2:
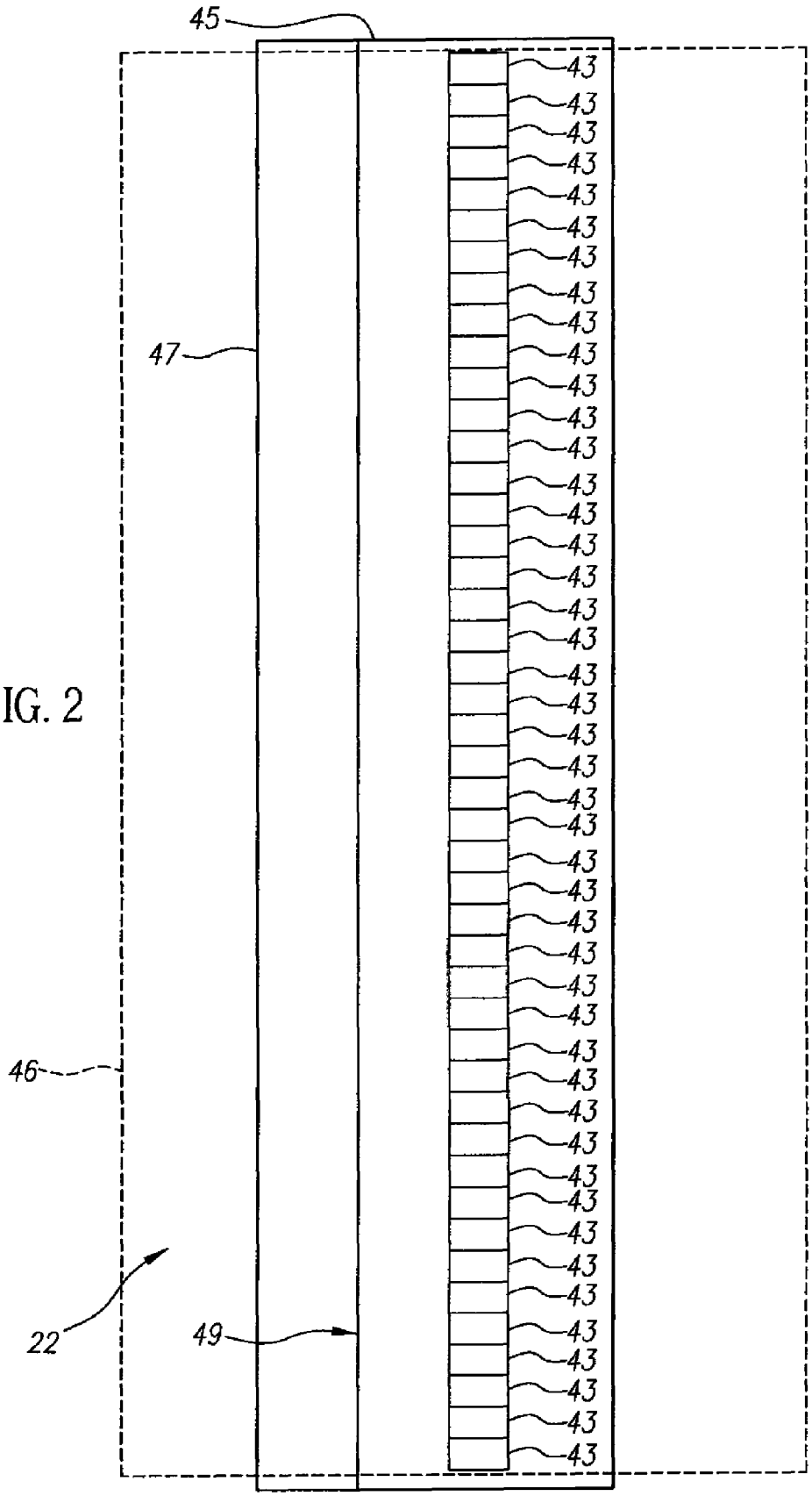
FIG. 2 shows a bottom view of one embodiment of a thermal printhead used in the printer of FIG. 1.

FIG. 2 shows a bottom view of an illustration of one embodiment of a conventional thermal printhead 22 with an array of thermal resistors 43 fabricated in a ceramic substrate 45. A heat sink 47, typically in the form of an aluminum backing plate, is fixed to a left side 49 of ceramic substrate 45. Heat sink 47 rapidly dissipates heat generated by the thermal resistors 43 during printing. In the embodiment shown in FIG. 2, thermal resistors 43 are arranged in a linear array extending across platen roller 46 (shown in phantom). Such a linear arrangement of thermal resistors 43 is commonly known as a heat line or print line. However, other non-linear arrangements of thermal resistors 43 can be used. Further, it will be appreciated that there are a wide variety of other arrangements of thermal resistors 43 and thermal printheads 22 that can be used in conjunction with the present invention.

Thermal resistors 43 are adapted to generate heat in proportion to an amount of electrical energy that passes through thermal resistors 43. During printing, controller 20 transmits signals to a circuit board 51 to which thermal resistors 43 are connected causing different amounts of electrical energy to be applied to thermal resistors 43 so as to selectively heat donor web 30 in a manner that is intended to cause donor material from donor patches 34, 36, 38, and 40 to be applied to receiver web 26 in a desirable manner.

Figure 3:
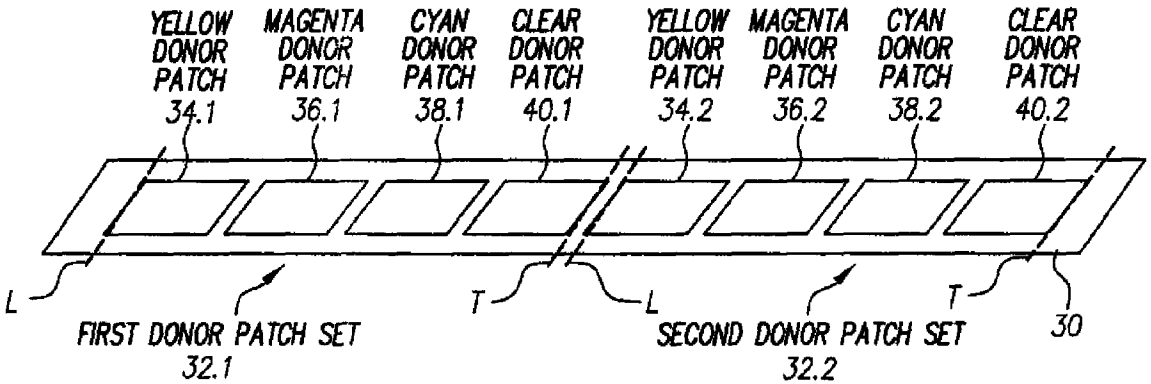
FIG. 3 shows a donor web.

As is shown in FIG. 3, donor web 30 comprises a first donor patch set 32.1 having a yellow donor patch 34.1, a magenta donor patch 36.1, a cyan donor patch 38.1, a clear donor patch 40.1; and a second donor patch set 32.2 having a yellow donor patch 34.2, a magenta donor patch 36.2, a cyan donor patch 38.2, and a clear donor patch 40.2. Each donor patch set 32 has a leading edge L and a trailing edge T. In order to provide a full color image with a clear protective coating, the four patches of each set 32.1 and 32.2; etc., are printed, in registration with each other, onto a common image receiving area 52 of receiver web 26 shown in FIG. 4. Circuit board 51 provides variable electrical signals to thermal resistors 43 in accordance with the signal from controller 20.

A first color is printed in the conventional direction, from right to left as seen by the viewer in FIGS. 1 and 3. During printing, controller 20 raises thermal printhead 22 and actuates donor web supply roller 50 and donor web take-up roller 48 to advance a leading edge L of a first donor patch set 32.1 to thermal printhead 22. In the embodiment illustrated in FIGS. 1 through 3, leading edge L for first donor patch set 32.1 is defined by a leading edge of a yellow donor patch 34.1. As will be discussed in greater detail below, the position of this leading edge L can be determined by using a position sensor to detect a marking indicia on donor web 30 that has a known position relative to the leading edge of yellow donor patch 34.1 or by directly detecting leading edge of yellow donor patch 34.1 as will be discussed in greater detail below.

Controller 20 also actuates receiver web take-up roller 42 and receiver web supply roller 44 so that image receiving area 52 of receiver web 26 is positioned with respect to the thermal printhead 22. In the embodiment illustrated, image receiving area 52 is defined by a leading edge LER and a trailing edge TER on receiver web 26. Donor web 30 and receiver web 26 are positioned so that leading edge LED of yellow donor patch 34.1 is registered at thermal printhead 22 with leading edge LER of image receiving area 52. Controller 20 then causes a motor or other conventional structure (not shown) to lower thermal printhead 22 so that a lower surface of donor web 30 engages receiver web 26 which is supported by platen roller 46. This creates a pressure holding donor web 30 against receiver web 26.

Controller 20 then actuates receiver web take-up roller 42, receiver web supply roller 44, donor web take-up roller 48, and donor web supply roller 50 to move receiver web 26 and donor web 30 together past the thermal printhead 22. Concurrently, controller 20 selectively operates heater elements in thermal printhead 22 to transfer donor material yellow donor patch 34.1 to receiver web 26.

Figure 4:
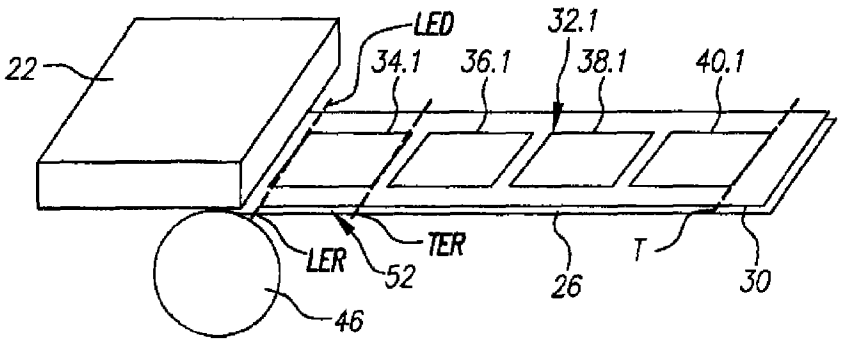
FIG. 4 shows a thermal printhead, platen, donor web, and receiver web during printing.

As donor web 30 and receiver web 26 leave the thermal printhead 22, a stripping plate 54 separates donor web 30 from receiver web 26. Donor web 30 continues over idler roller 56 toward the donor web take-up roller 48. As shown in FIG. 4, the trailing edge TER of image receiving area 52 of receiver web 26 remains on platen roller 46. Controller 20 then adjusts the position of donor web 30 and receiver web 26 using a predefined pattern of donor web movement so that a leading edge of each of the remaining donor patches 36.1, 38.1 and 40.1 in the first donor patch set 32.1 are brought into alignment with leading edge LER of image receiving area 52 and the printing process is repeated to transfer further material as desired to complete image format.

Controller 20 operates the printer 18 based upon input signals from a user input system 62, an output system 64, a memory 68, a communication system 74, and sensor system 80. User input system 62 can comprise any form of transducer or other device capable of receiving an input from a user and converting this input into a form that can be used by controller 20. For example, user input system 62 can comprise a touch screen input, a touch pad input, a 4-way switch, a 6-way switch, an 8-way switch, a stylus system, a trackball system, a joystick system, a voice recognition system, a gesture recognition system or other such systems. An output system 64, such as a display, is optionally provided and can be used by controller 20 to provide human perceptible signals for feedback, informational or other purposes.

Data including, but not limited to, control programs, digital images and metadata can also be stored in memory 68. Memory 68 can take many forms and can include without limitation conventional memory devices including solid state, magnetic, optical or other data storage devices. In the embodiment of FIG. 1, memory 68 is shown having a removable memory interface 71 for communicating with removable memory (not shown) such as a magnetic, optical or magnetic disks. In the embodiment of FIG. 1, memory 68 is also shown having a hard drive 72 that is fixed with printer 18 and a remote memory 76 that is external to controller 20 such as a personal computer, computer network or other imaging system.

In the embodiment shown in FIG. 1, controller 20 has a communication system 74 for communicating external devices such as remote memory 76. Communication system 74 can be for example, an optical, radio frequency circuit or other transducer that converts electronic signals representing an image and other data into a form that can be conveyed to a separate device by way of an optical signal, radio frequency signal or other form of signal. Communication system 74 can also be used to receive a digital image and other information from a host computer or network (not shown). Controller 20 can also receive information and instructions from signals received by communication system 74.

Sensor system 80 includes circuits and systems that are adapted to detect conditions within printer 18 and, optionally, in the environment surrounding printer 18 and to convert this information into a form that can be used by controller 20 in governing printing operations. Sensor system 80 can take a wide variety of forms depending on the type of media therein and the operating environment in which printer 18 is to be used.

In the embodiment of FIG. 1, sensor system 80 includes an optional donor position sensor 82 that is adapted to detect the position of donor web 30 and a receiver web position sensor 84. Controller 20 cooperates with donor position sensor 82 to monitor donor web 30 during movement thereof so that controller 20 can detect one or more conditions on donor web 30 that indicate a leading edge of a donor patch set. In this regard, a donor web 30 can be provided that has markings or other optically, magnetically or electronically sensible indicia between each donor patch set 32 and/or between donor patches 34, 36, 38, and 40. Where such markings or indicia are provided, donor position sensor 82 is provided to sense these markings or indicia and to provide signals to controller 20. Controller 20 can use these markings and indicia to determine when donor web 30 is positioned with the leading edge of the donor patch set at thermal printhead 22. In a similar way, controller 20 can use signals from receiver web position sensor 84 to monitor the position of the receiver web 26 to align receiver web 26 during printing. Receiver web position sensor 84 can be adapted to sense markings or other optically, magnetically or electronically sensible indicia between each image receiving area of receiver web 26.

During a full image printing operation, controller 20 causes donor web 30 to be advanced in a predetermined pattern of distances so as to cause a leading edge of each of the first donor patches 34.1, 36.1, 38.1, and 40.1 to be properly positioned relative to the image receiving area 52 at the start each printing process. Controller 20 can optionally be adapted to achieve such positioning by precise control of the movement of donor web 30 using a stepper type motor for motorizing donor web take-up roller 48 or donor web supply roller 50 or by using a movement sensor 86 that can detect movement of donor web 30. In one example, an arrangement using a receiver web position sensor 84, a follower wheel 88 is provided that engages donor web 30 and moves therewith. Follower wheel 88 can have surface features that are optically, magnetically or electronically sensed by movement sensor 86. One example of this is a follower wheel 88 that has markings thereon indicative of an extent of movement of donor web 30 and a movement sensor 86 that has a light sensor that can sense light reflected by the markings. In other optional embodiments, perforations, cutouts or other routine and detectable indicia can be incorporated onto donor web 30 in a manner that enables movement sensor 84 to provide an indication of the extent of movement of the donor web 30.

Alternatively, donor position sensor 82 can also optionally be adapted to sense the color of donor patches on donor web 30 and can provide color signals to controller 20. In this alternative, controller 20 is programmed or otherwise adapted to detect a color that is known to be found in the first donor patch, e.g., yellow donor patch 34.1 in a donor patch set such as first donor patch set 32.1. When the first color is detected, controller 20 can determine that donor web 30 is positioned proximate to the start of a donor patch set.

Figure 6:
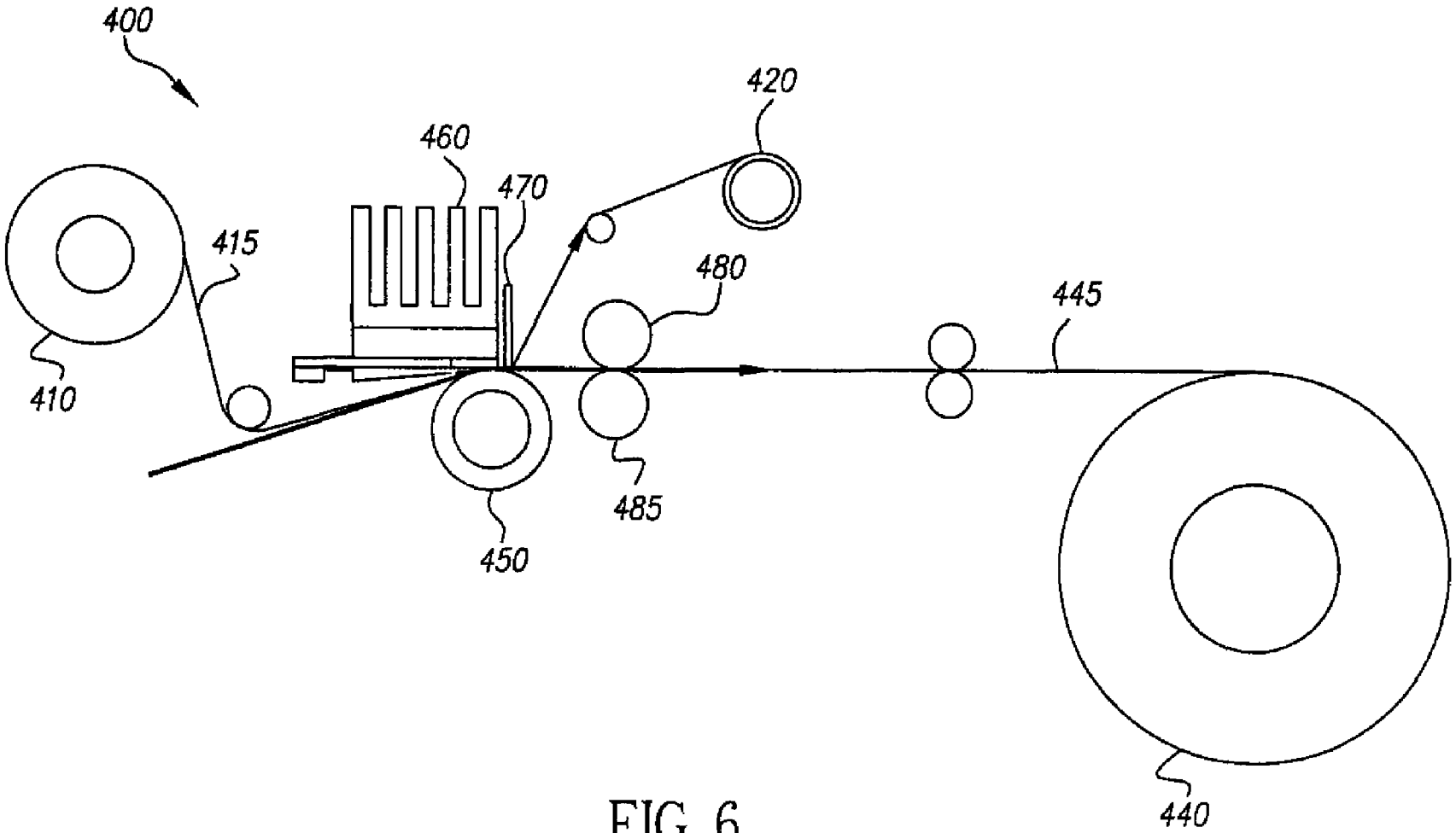
FIG. 6 illustrates an exemplary thermal printer system.

An exemplary thermal printer schematic 400, shown in FIG. 6, includes a donor supply spool 410 for distributing a donor web 415. A donor take-up spool 420 removes slack donor web 415. A receiver supply spool 440 distributes receiver web 445. Receiver web 445 and donor web 415 are merged together atop platen roller 450 and beneath a thermal ceramic printhead 460 that includes a grounded heat sink and a peel member 470. Subsequent to the thermal ceramic printhead 460 adhering donor material on the donor web 415 to receiver web 445, the peel member 470 separates the donor web 415 from the receiver web 445. Donor web 415 continues to travel on to the donor take-up spool 420, while the receiver web 445 travels between a pinch roller 480 and a micro-grip roller 485 that form a nip.

Figure 5:
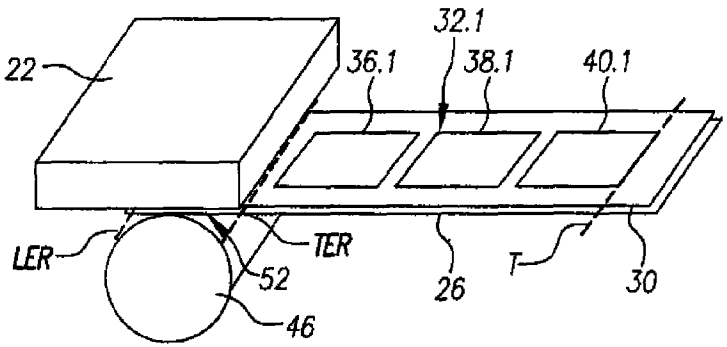
FIG. 5 shows a thermal printhead, platen, donor web, and receiver web during printing.
Figure 7A:
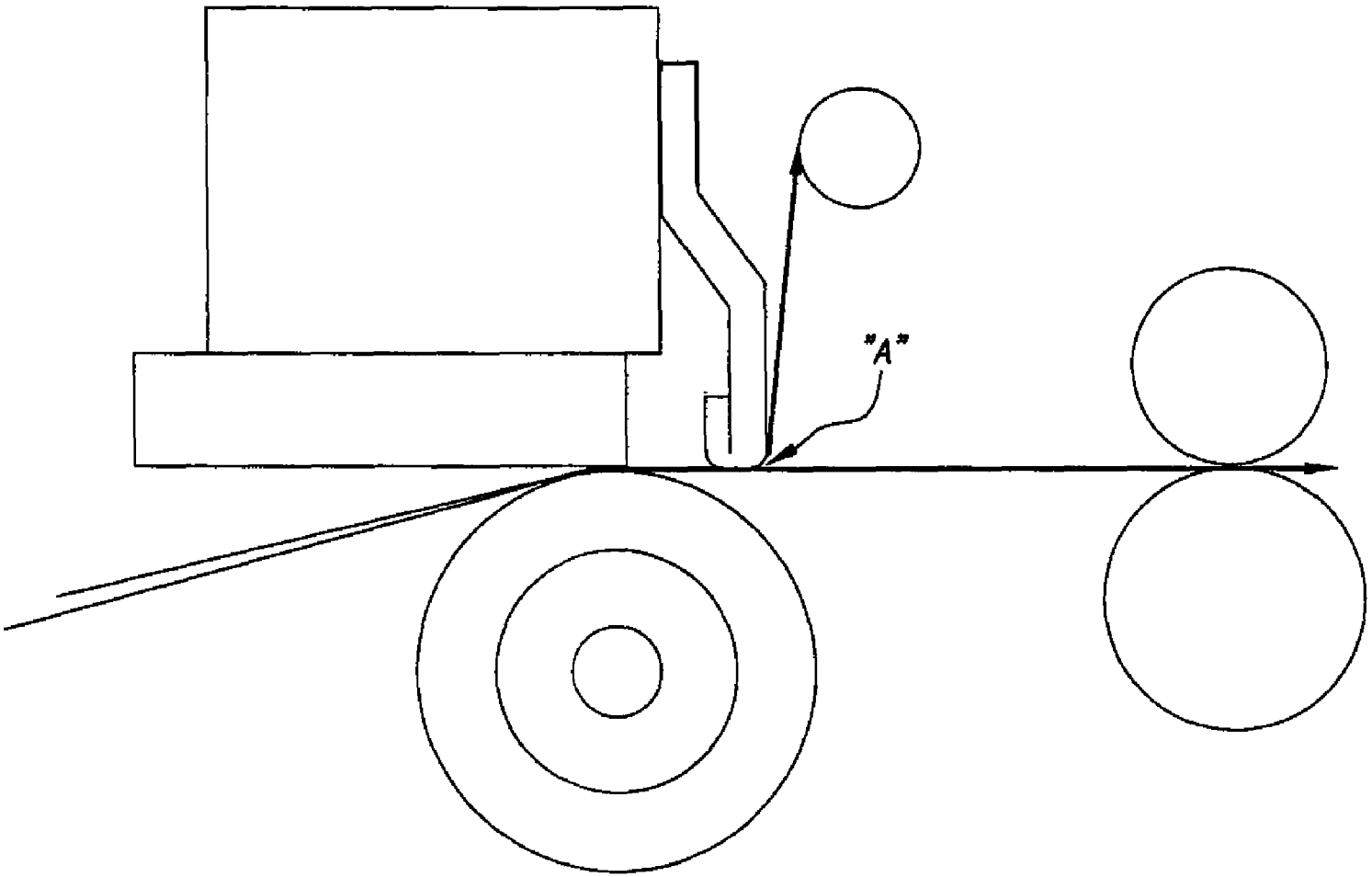
FIG. 7 illustrates electrical isolation from ground of peel member assembly.

In FIG. 7A, peel member 470 is metal and ungrounded, i.e., not electrically connected to the earth, yet thermally conductive. Hence, peel member 470 is electrically isolated from ground. The electrical isolation of the peel member 470 from ground removes build-up of electrical charge static charge at a point on the peel member 470 where either one or both of the donor web 415 or the receiver web 445 contact peel member 470 (shown in FIG. 5). Therefore, at contact point "A" there will be no apparent electrical static charge transfer as a result of either donor web 415 or receiver web 445 contacting peel member 470.

Figure 7B:
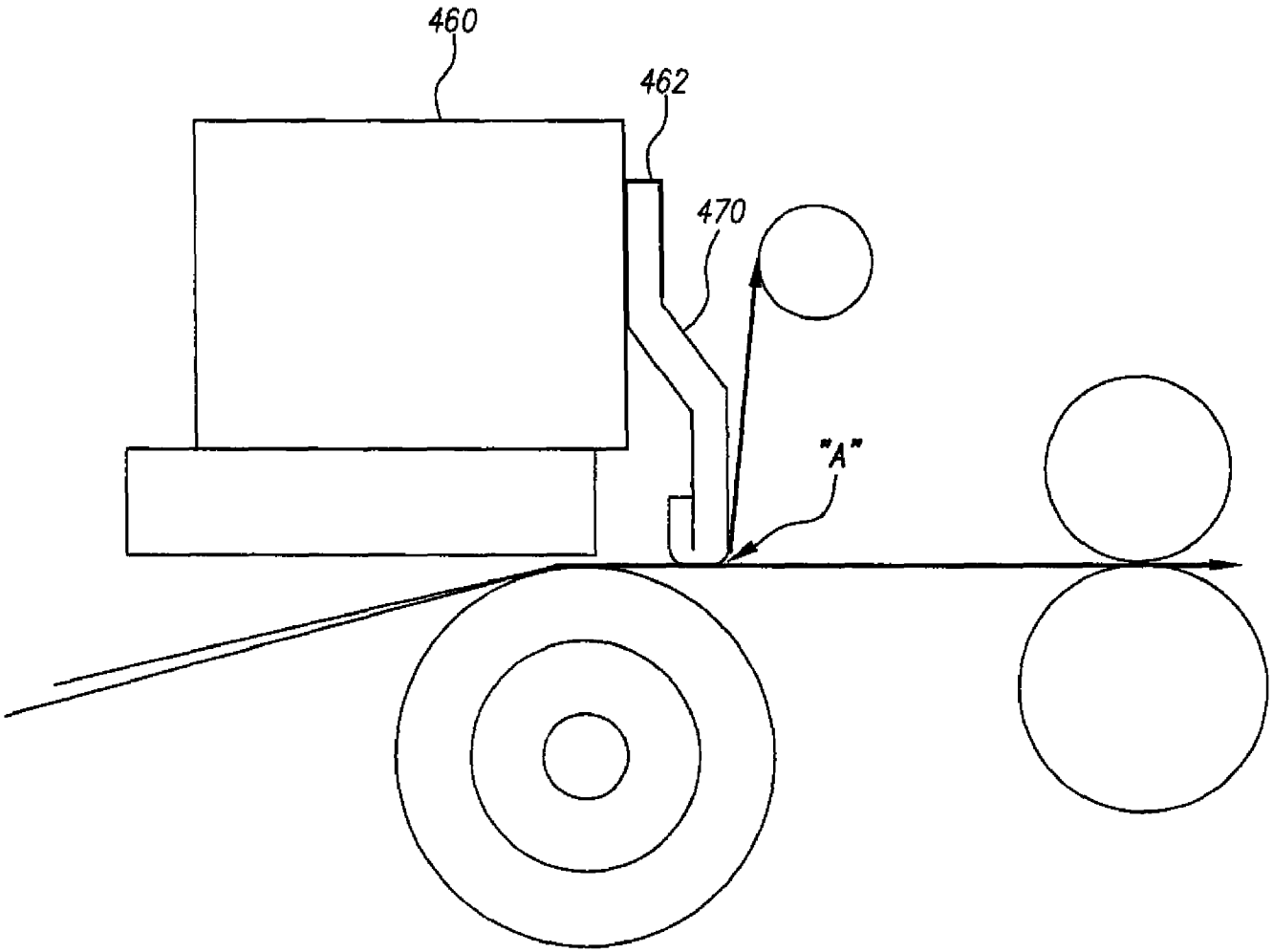

In FIG. 7B, an alternative embodiment includes a resistance of at least one mega-ohm provided by a high resistance component 462 that substantially electrically isolates peel member 470 from thermal printhead 461 with heat sink 465.

Peel member 470 can be a plate, a roller, or a bar. Alternatively, peel member 470 can be a combination of either—a plate, roller, or bar. Sources of resistance, that enable electrical isolation of peel member 470 from thermal printhead with heat sink 465 can include non-conductive tape and plastic washers.

Figure 8:
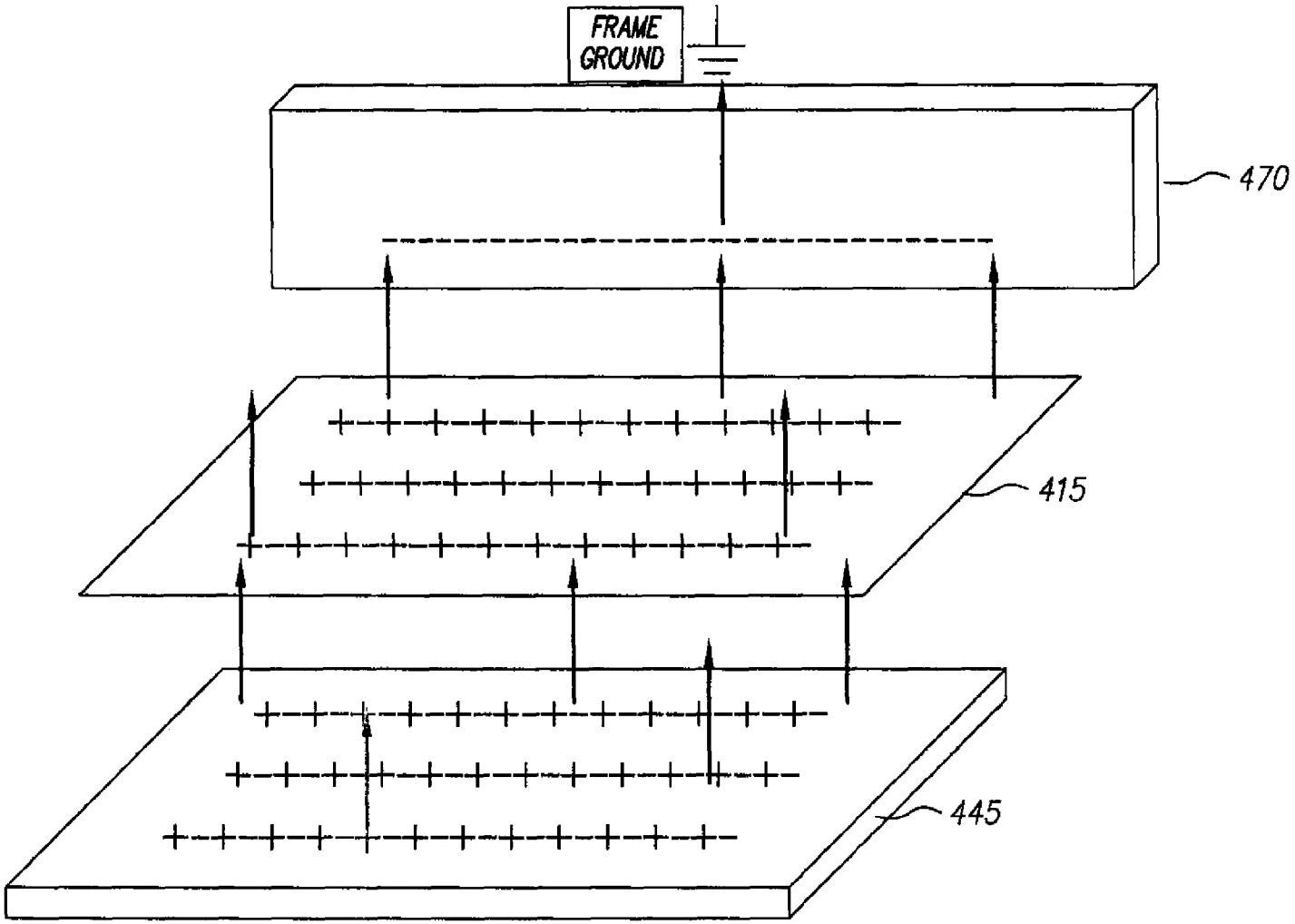
FIG. 8 illustrates a triboelectric effect upon the peel member assembly.

Conventional wisdom, involving electrical current and electrical conductive material, states that the electrical conductive material should be grounded. Applicants' novel approach reduces transfer of electrostatic charge, because peel member 470 is at least substantially electrically isolated. FIG. 8 illustrates a triboelectric effect (increased static charge) when the conductive surface of peel member 470 is grounded to the frame of a thermal printer. Electrostatic charge transfer to the peel member 470 creates an imbalance in electrostatic charge on a donor web or a receiver web that can cause buckling of print media, either a receiver sheet or a donor sheet. Most likely, the receiver sheet is more negatively impacted because the receiver sheet will have difficulty exiting the printer.

Figure 9:
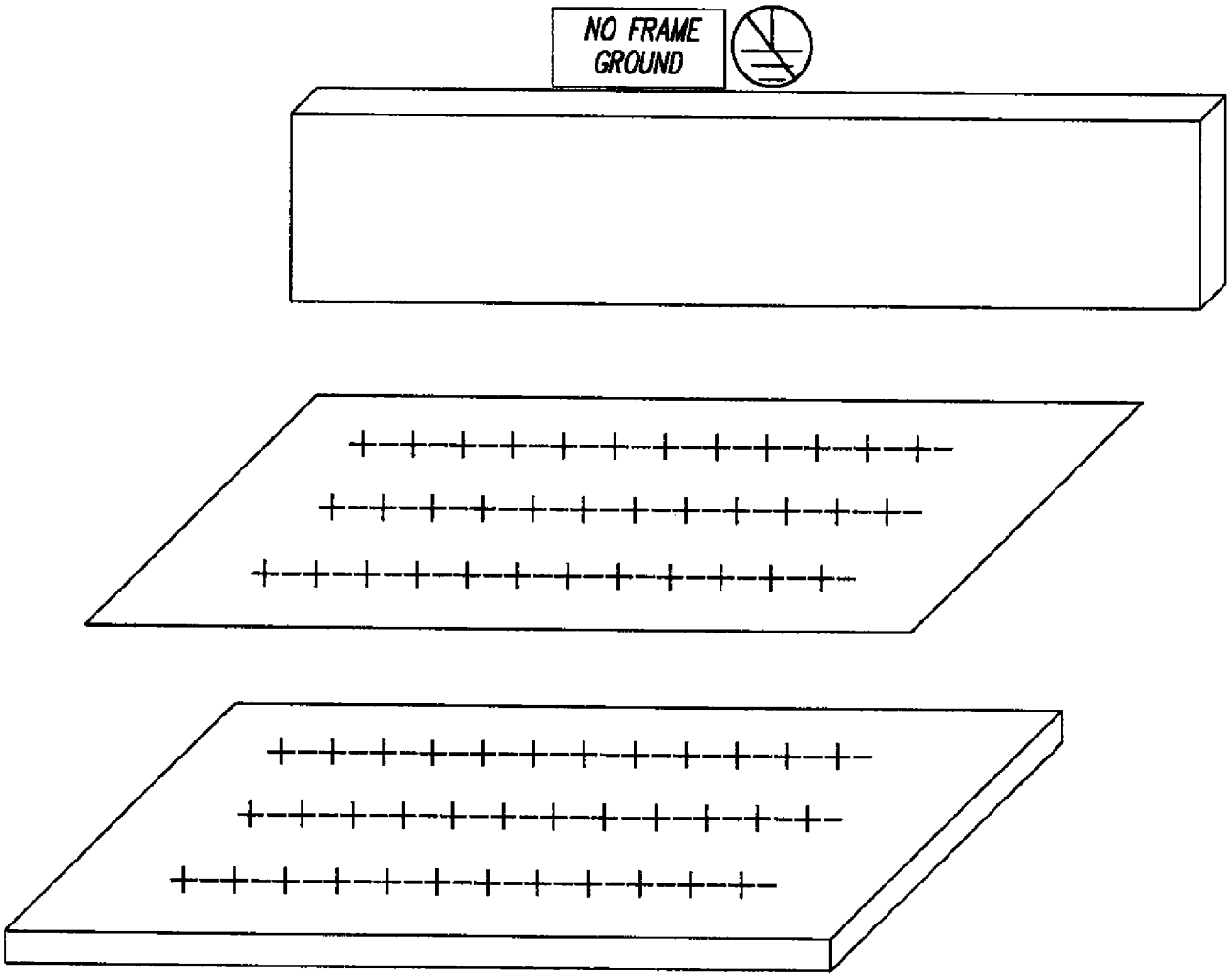
FIG. 9 illustrates no triboelectric effect upon the peel member assembly.

In sharp contrast to FIG. 8, FIG. 9 illustrates that there is minimal or substantially reduced electrostatic charge transferred to peel member 470 when peel member 470 is electrically isolated from ground. Elimination of, or greatly reduced electrostatic charge transfer to the peel member 470 (as shown in FIG. 9), ensures substantially reduced migration of charge and keeps near balance of existing charges on both the non-polar surface of receiver web 445 and the non-polar surface of donor web 415.

Figure 10:
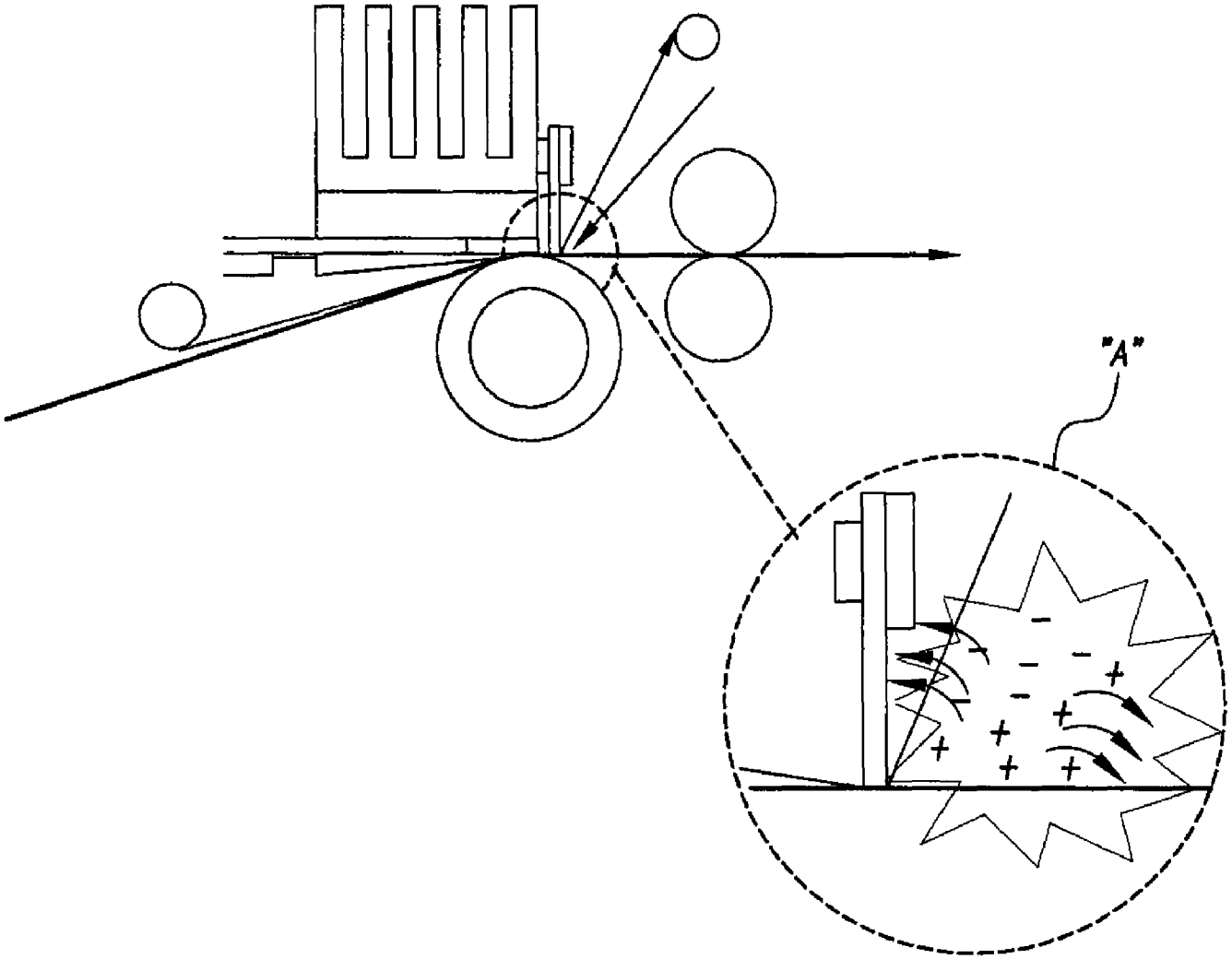
FIG. 10 illustrates triboelectric effect at critical contact point for peel member, donor web, and receiver web.

A view of a triboelectric effect, as shown in FIG. 10, illustrates that the donor web 415 and the receiver web 445, together at a contact point "A" on peel member 470 generates an electrostatic field. A grounded peel member 470 allows a portion of the static charge to go to ground, resulting in a polar charge on the receiver.

Figure 11:
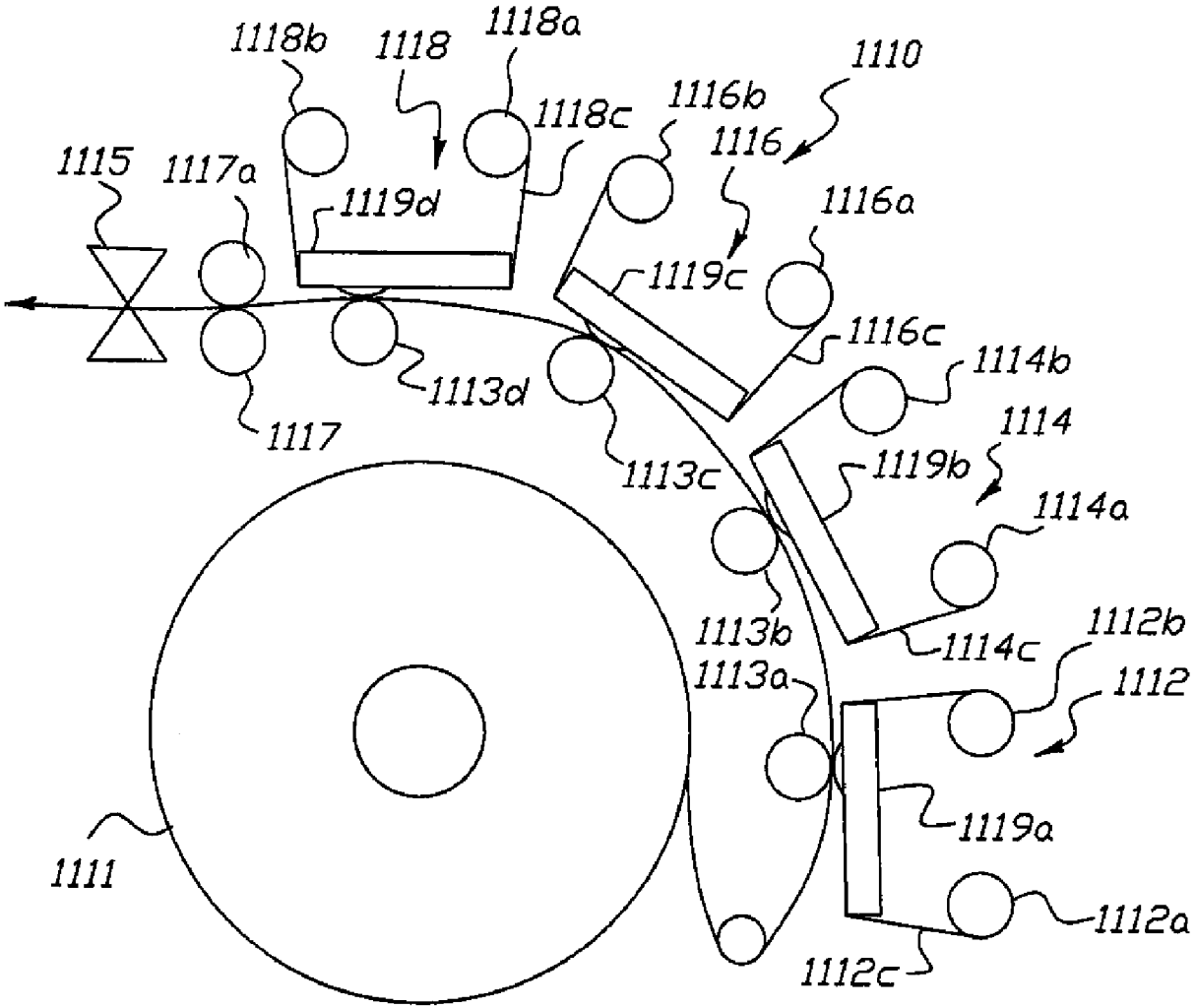
FIG. 11 illustrates a prior art multi-headed printer.

A prior-art multi-headed printer is illustrated in FIG. 11. The present invention can be employed for a multi-headed printer as well. In this case, one or more peel plates would be used.

Referring to FIG. 11, reference is to a single pass, multicolor thermal printer of the type described in U.S. Pat. No. 5,440,328. In such a printer, a print engine 1110 is provided that comprises a receiver transport system and three or more thermal printhead assemblies 1112, 1114 and 1116. Each of the printhead assemblies includes a respective re-loadable thermal ribbon cassette assembly which is loaded with a color transfer ribbon 1112*c*, 1114*c*, and 1116*c*. Each of the thermal printhead assemblies comprises a thermal printhead 1119*a-d* having a thermal print line. Each of the thermal printhead assemblies further has a counterpart platen roller 1113*a-d* with which a respective printhead forms a respective nip and through which a receiver 1111 passes in combination with the respective color ribbon of dye. The mounting assemblies allow the thermal printheads' positions to be adjusted so that the mounting assemblies can be pivoted towards and away from the respective platen rollers. In this regard, the mounting assemblies are pivotable between an "up" position, wherein the thermal printheads are disengaged from the platen rollers and a "down" position wherein the printheads are in biased engagement with the platen rollers.

Each reloadable ribbon cassette assembly comprises a cassette body including a ribbon supply roll 1112*a*, 1114*a* or 1116*a* and a ribbon take-up roll 1112*b*, 1114*b* or 1116*b*. The ribbon cassette assemblies are loaded with one of three or more primary color ribbons 1112*c*, 1114*c*, and 1116*c*, which are used in conventional subtractive color printing. The supply and take-up rolls of each ribbon cassette assembly are coupled to individual ribbon drive sub-assemblies when the cassette assembly is loaded into the printer for printing images on the receiver. In addition to an assembly for each of the color ribbons, there may also be provided a ribbon cassette assembly 1118 that is provided with a supply of transparent ribbon 1118*c* that can transfer an overcoat layer to the receiver after an image has been printed thereon. The transparent ribbon cassette assembly is similar in all respects to the other assemblies (including supply and take-up rolls 1118*a* and 1118*b*), and a separate printhead is used to transfer the overcoat layer to the now imaged receiver. Different types of transparent ribbon may be used to provide matt or glossy finish overcoats to the final print. Alternatively, the printhead associated with the transparent ribbon may have the respective recording elements suitably modulated to create different finish overcoats to the final print.

Receiver 1111 having a coating thereon for receiving a thermal dye is supported as a continuous roll and threaded about platen rollers 1113*a-d*. The receiver is also threaded through a nip comprised of a capstan drive roller 1117 and a back-up roller 1117*a*. As the receiver is driven by the capstan drive roller the receiver passes by each thermal printhead assembly 1112, 1114, and 1116 a respective color dye image is transferred to the receiver sheet to form the multicolor image. For example, thermal printhead assembly 1112 may provide a yellow color separation image, thermal printhead assembly 1114 may provide a magenta color separation image, and thermal printhead assembly 1116 may provide a cyan color separation image to form a three color multicolor image on the receiver sheet. Fourth ribbon cassette assembly 1118 thermally transfers the transparent overcoat to protect the color image from for example fingerprints. At each of the four assemblies there is provided a thermal printhead 1119*a-d* that has recording elements selectively enabled in accordance with image information to selectively transfer color dye to the receiver or in the case of the transparent ribbon to transfer the overcoat layer to the now imaged receiver sheet. At each thermal print assembly, platen rollers 1113*a-d*, form a respective printing nip with the respective printhead 1119*a-d*. As the receiver is driven through each of the respective nips, the movement of the receiver advances corresponding primary color ribbon 1112*c*, 1114*c*, 1116*c* and 1118*c* through the respective nip as well. After each multicolor image is formed, a cutter 1115 may be enabled to cut the receiver into a discrete sheet containing the multicolor image protected by the transparent overcoat layer.

Figure 12:
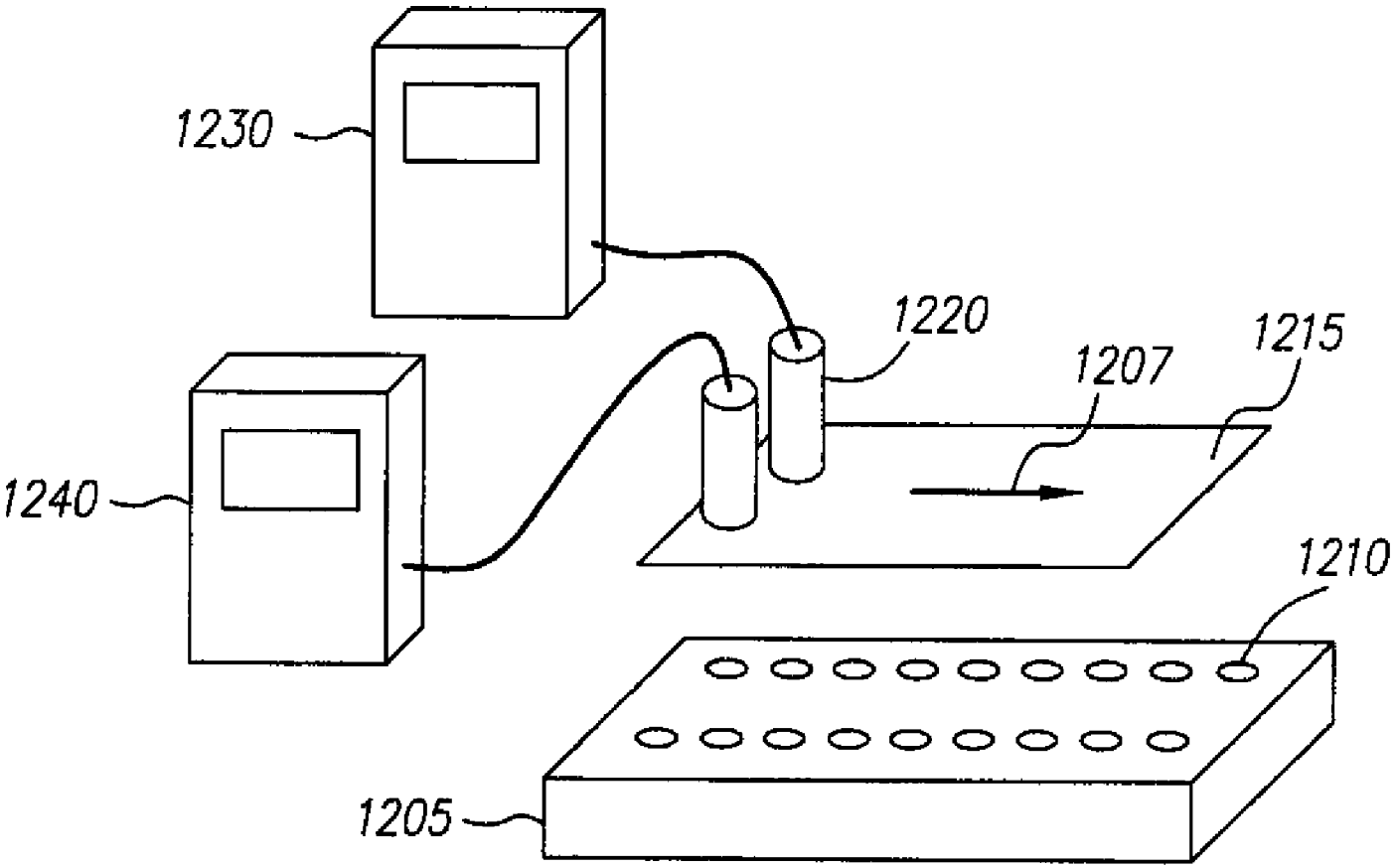
FIG. 12 shows an apparatus for measuring surface voltage on a sheet of receiver material.

FIG. 12 shows an apparatus for measuring surface voltage including, an isolated metal surface plate 1205 having a plurality of vacuum holes 1210 on its surface. A black image sample 1215 on a sheet of receiver material has adhered to its surface dual volt meter probes 1220. These dual volt meter probes 1220 are capable of being positioned in different locations on the black image sample 1215. Sample voltage readings from volt meters 1230, 1240 when electrically connected to dual volt meter probes 1220 provide useful data on the amount of voltage difference between a grounded member and an isolated peel plate. Peel members can be plates.

In addition, the following test procedure for measuring voltages on image side of a printed sheet of receiver material is included below:

A Kodak Ektatherm™ donor and receiver from media kit type 838-0370 was used in this test. Black imaged samples of receiver material are generated by an experimental printer which transfers yellow, magenta, and cyan dye patches and a protective laminate patch onto the surface of the receiver. Samples were produced with and without grounding of the printer peel member 1205, and were measured for surface voltage using the procedure described below.

Probes from two Trek™ Model 347 Electrostatic Voltmeters are placed over an isolated metal plate (see FIG. 12) and calibrated to give zero response according to the manufacturer's procedure. A sheet of receiver material is placed on the metal plate with the imaged side uppermost. The metal plate contains holes connected to a vacuum pump to ensure intimate contact with the sheet of receiver material. The probes are moved over the surface of the sheet, maintaining a constant probe-sheet gap by using a supporting bar which slides across the metal plate. Surface voltage is recorded at selected positions along the sheet of receiver material.

Readings from the two Trek™ Model 347 Electrostatic Voltmeters when the sheets of receiver material are mounted to the isolated metal surface plate:

| Image Side of Sheet of Receiver Material | | |
|---|---|---|
| Voltage Reading Point | Grounded Peel Plate Test (Voltage) | Isolated Peel Plate Test (Voltage) |
| 1 | 0 | 0 |
| 2 | −210 | 15 |
| 3 | −230 | 15 |
| 4 | −230 | 15 |
| 5 | −225 | 15 |
| 6 | −220 | 15 |
| 7 | −220 | 15 |
| 8 | −175 | 15 |
| 9 | −75 | 0 |
| 10 | 0 | 0 |

The invention has been described in detail with particular reference to certain preferred embodiments thereof, but it will be understood that variations and modifications can be effected within the spirit and scope of the invention.

| PARTS LIST | |
|---|---|
| 18 | Printer |
| 20 | Controller |
| 22 | Thermal Printhead |
| 26 | Receiver Web |
| 30 | Donor Web |
| 32 | Donor Patch Set |
| 32.1 | First Donor Patch |
| 32.2 | Second Donor Patch |
| 34 | Donor Patch |
| 34.1 | Yellow Donor Patch |
| 34.2 | Yellow Donor Patch |
| 36 | Donor Patch |
| 36.1 | Magenta Donor Patch |
| 36.2 | Magenta Donor Patch |
| 38 | Donor Patch |
| 38.1 | Cyan Donor Patch |
| 38.2 | Cyan Donor Patch |
| 40 | Donor Patches |
| 40.1 | Clear Donor Patch |
| 40.2 | Clear Donor Patch |
| 42 | Receiver Web Take-Up Roller |
| 43 | Thermal Resistors |
| 44 | Receiver Web Supply Roller |
| 45 | Ceramic Substrate |
| 46 | Platen Roller |
| 47 | Heat Sink |
| 48 | Donor Web Take-Up Roller |
| 49 | Aluminum Backing Plate |
| 50 | Donor Web Supply Roller |
| 51 | Circuit Board |
| 52 | Image Receiving Area |
| 56 | Idler Roller |
| 62 | Input System |
| 64 | Output System |
| 68 | Memory |
| 71 | Removable Memory Interface |
| 72 | Hard Drive |
| 74 | Communication System |
| 76 | Remote Memory |
| 80 | Sensor System |

-continued

| PARTS LIST | |
|---|---|
| 82 | Donor Position Sensor |
| 84 | Receiver Web Position Sensor |
| 86 | Movement Sensor |
| 88 | Follower Wheel |
| 400 | Thermal Printer Schematic |
| 410 | Donor Supply Spool |
| 415 | Donor Web |
| 420 | Donor Take-Up Spool |
| 440 | Receiver Supply Spool |
| 445 | Receiver Web |
| 450 | Platen Roller |
| 460 | Thermal Ceramic Printhead |
| 461 | Thermal Printhead |
| 462 | High Resistance Component |
| 465 | Heat Sink |
| 470 | Peel Member |
| 480 | Pinch Roller |
| 485 | Micro-Grip Roller |
| 1110 | Print Engine |
| 1111 | Receiver |
| 1112 | Thermal Printhead Assembly |
| 1112a | Ribbon Supply Roll |
| 1112b | Ribbon Take-Up Roll |
| 1112c | Primary Color Ribbon |
| 1113a-d | Platen Roller |
| 1114 | Thermal Printhead Assembly |
| 1114a | Ribbon Supply Roll |
| 1114b | Ribbon Take-Up Roll |
| 1114c | Primary Color Ribbon |
| 1115 | Cutter |
| 1116 | Thermal Printhead Assembly |
| 1116a | Ribbon Supply Roll |
| 1116b | Ribbon Take-Up Roll |
| 1116c | Primary Color Ribbon |
| 1117 | Capstan Drive Roller |
| 1117a | Back-Up Roller |
| 1118 | Ribbon Cassette Assembly |
| 1118c | Transparent Ribbon |
| 1119a-d | Thermal Printhead |
| 1205 | Metal Surface Plate |
| 1210 | Vacuum Holes |
| 1215 | Black Image Sample |
| 1220 | Dual Volt Meter Probes |
| 1230 | Volt Meters |
| 1240 | Volt Meters |
| A | Contact Point |
| L | Leading Edge |
| T | Trailing Edge |
| LED | Leading Edge |
| TED | Trailing Edge |
| LER | Leading Edge |
| TER | Trailing Edge |

What is claimed is:

1. A thermal printer having reduced electrical charge built at point of separation of a donor web and a receiver web, comprising:

a) at least one thermal printhead;

b) at least one platen roller with a nip formed between the at least one thermal printhead and the at least one platen roller through which the donor web and the receiver web can be drawn;

c) a heat sink attached to the at least one thermal printhead;

d) a peel member located downstream of the nip; and (e) a high resistance component connected to the peel member and to the ground.

2. The thermal printer as recited in claim 1, further comprising a support structure for the peel member, wherein the support structure for the peel member is electrically isolated from ground.

3. The thermal printer as recited in claim 2, wherein the support structure for the peel member is the heat sink attached to the at least one thermal printhead.

4. The thermal printer as recited in claim 1 wherein the peel member is electrically isolated from ground apart from the heat sink when the heat sink itself is electrically connected to ground.

5. An improved thermal printer as recited in claim 4, wherein the peel member is supported from the heat sink and is separated from direct contact with the heat sink with a dielectric material.

6. An improved thermal printer as recited in claim 1, wherein the high resistance component is a resistor of at least 500 kilo-ohms.

7. An improved thermal printer as recited in claim 1, wherein the high resistance component is an air gap.

8. An improved thermal printer as recited in claim 1, wherein the peel member is a plate.

9. An improved thermal printer as recited in claim 1, wherein the peel member is a non-rotating shaft.

10. An improved thermal printer as recited in claim 1, wherein the peel member is a roller assembly.

11. An improved thermal printer as recited in claim 1, wherein the peel member is supported within a printer housing.

12. A method for eliminating built-up electrical static charge in a thermally conductive peel member assembly, comprising the steps of:

a) electrically isolating the thermal conductive peel member from ground;

b) maintaining the thermal conductive peel member's physical proximate contact with a heat sink assembly of a thermal printhead; and c) connecting the peel member to a high resistance component including connecting the high resistance component to the ground.

13. The method as recited in claim 12, wherein the step of electrically isolating includes:

providing a support structure for the peel member including using the heat sink assembly as the support structure; and electrically isolating the heat sink assembly from ground.

14. The method as recited in claim 12, further comprising maintaining the electrical isolation of the peel member from ground when the heat sink assembly is electrically connected to ground.

15. The method as recited in claim 12, further comprising using a resistor of at least 500 kilo-ohms as the high resistance component.

16. The method as recited in claim 12, further comprising using an air gap as the high resistance component.

17. The method as recited in claim 12, further comprising using a non-rotating shaft as the peel member.

18. The method as recited in claim 12, further comprising providing a dielectric material to separate the peel member from direct electrical contact with the heat sink assembly.

* * * * *